US008925536B2

(12) United States Patent
Derus

(10) Patent No.: US 8,925,536 B2
(45) Date of Patent: Jan. 6, 2015

(54) ARCHERY CABLE GUARD AND STRING STOP

(71) Applicant: Perfect Form Manufacturing LLC, Wilmington, DE (US)

(72) Inventor: Michael Derus, Hudson, FL (US)

(73) Assignee: Perfect Form Manufacturing LLC, Wilmington, DE (US)

( * ) Notice: Subject to any disclaimer, the term of this patent is extended or adjusted under 35 U.S.C. 154(b) by 71 days.

(21) Appl. No.: 13/726,666

(22) Filed: Dec. 26, 2012

(65) Prior Publication Data

US 2013/0160753 A1 Jun. 27, 2013

Related U.S. Application Data

(60) Provisional application No. 61/580,456, filed on Dec. 27, 2011.

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01)
USPC ..... 124/25.6

(58) Field of Classification Search
USPC ..... 124/25.6, 86, 88
See application file for complete search history.

(56) References Cited

U.S. PATENT DOCUMENTS

| | | | | |
|---|---|---|---|---|
| 422,361 | A * | 3/1890 | Alton | 411/433 |
| 5,911,215 | A * | 6/1999 | Fisher, Jr. | 124/86 |
| 6,176,231 | B1 * | 1/2001 | Smith | 124/25.6 |
| 6,568,382 | B2 * | 5/2003 | Martin et al. | 124/86 |

* cited by examiner

*Primary Examiner* — John Ricci
(74) *Attorney, Agent, or Firm* — Hiscock & Barclay, LLP

(57) ABSTRACT

A cable guard and string stop for use with archery bows. The cable guard and string stop partially reside within a first bore in the archery bow. A screw and retention device is installed in a second bore, orthogonal to and intersecting the first bore. The retention device frictionally engages the cable guard or string stop to secure the cable guard in place.

26 Claims, 3 Drawing Sheets

ARCHERY CABLE GUARD AND STRING STOP

CROSS-REFERENCE TO RELATED APPLICATIONS

This application claims priority to and the benefit of U.S. provisional patent application Ser. No. 61/580,456, filed Dec. 27, 2011, which application is incorporated herein by reference in its entirety.

BACKGROUND

The subject matter disclosed herein relates generally to the field of archery products. More particularly, this specification relates to a cable guard for attachment to archery bows. In another embodiment, this specification relates to a string stop for attachment to archery bows.

Archery bows have a number of cables. In particular, compound bows utilize a number of power cables in addition to the bowstring cable. These additional cables can interfere with the passage of the arrow during release. Therefore, cable guards are often used to provide adequate clearance for the arrow to pass by the cables without being impeded and altering flight characteristics of the arrow. There is a need for effective attachment of cable guards to archery bows.

Upon release of a drawn archery bow, the bowstring transfers energy to an arrow. To prevent the bowstring from continuing to travel in the direction that the arrow is fired, string stops are often used. Once adjusted, the bowstring contacts the string stop, preventing the bowstring from any further travel into the shooters arm or into the power cables. There is a need for effective attachment of string stops to archery bows.

The discussion above is merely provided for general background information and is not intended to be used as an aid in determining the scope of the claimed subject matter.

BRIEF DESCRIPTION

The subject matter disclosed herein provides a retention device for attaching a cable guard or string stop to the riser of a bow. More particularly, the retention device attaches to the riser by threading into the riser. Upon tightening, the retention device compresses against a cable guard to retain the cable guard in place. It is understood that the same retention device can be utilized for attachment of a string stop in a similar fashion.

A cable guard for use with archery bows. The cable guard partially resides within a first bore in the archery bow. A screw and retention device is installed in a second bore, generally orthogonal to and intersecting the first bore. The retention device frictionally engages the cable guard to secure the cable guard in place.

An advantage that may be realized in the practice of some disclosed embodiments of the cable guard is the screw attaches directly to the archery bow without the need for additional nuts or other attachment mechanisms.

In one exemplary embodiment, a archery bow is disclosed. The archery bow comprises a first bore extending into the riser and terminating within the riser; a second bore orthogonal to and intersecting the first bore; a cable guard inserted into the first bore; and a retention device in the second bore; wherein the retention device frictionally engages the cable guard to retain the cable guard to the archery bow.

This brief description is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION

Figure 1:
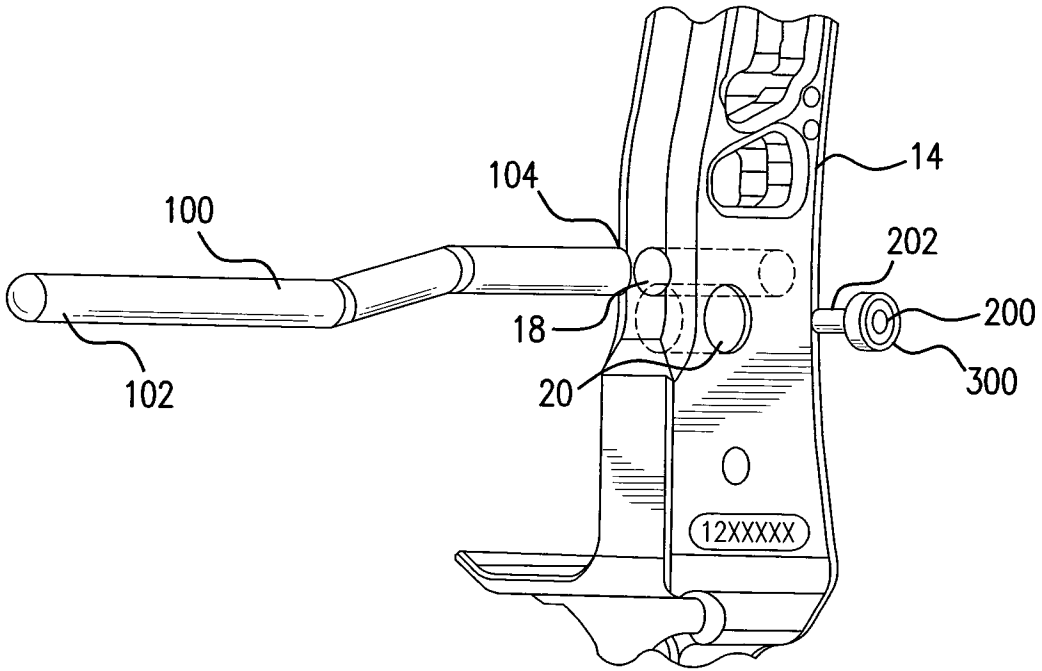
FIG. 1 is an exploded view of an exemplary cable guard according to one embodiment.
Figure 2:
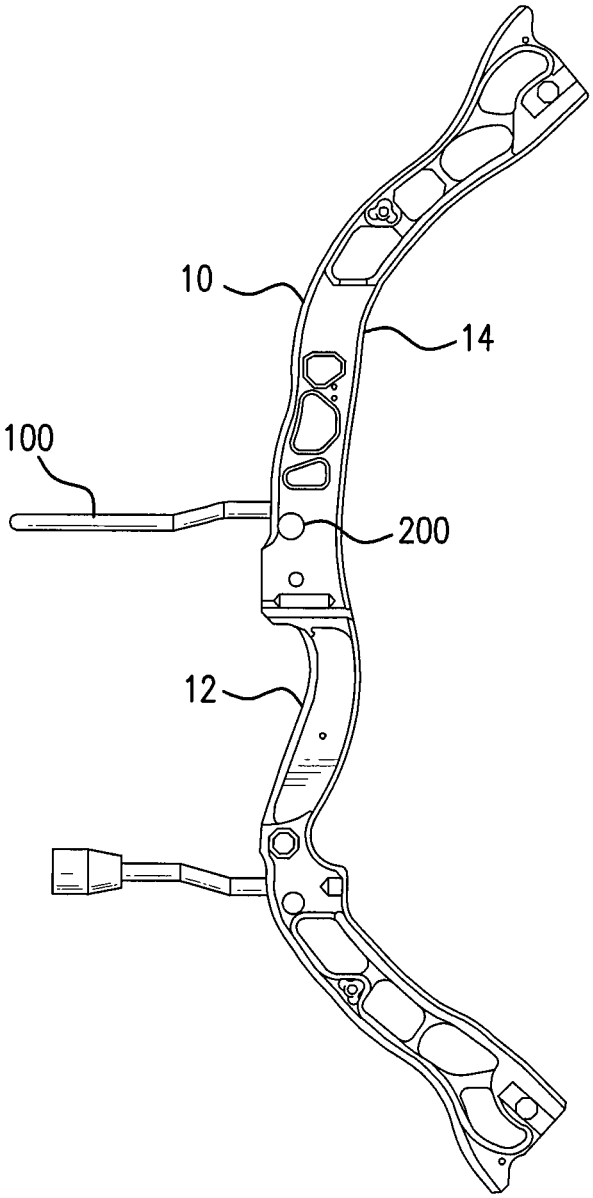
FIG. 2 is a side view of an archery bow having a cable guard installed according to one embodiment.
Figure 3:
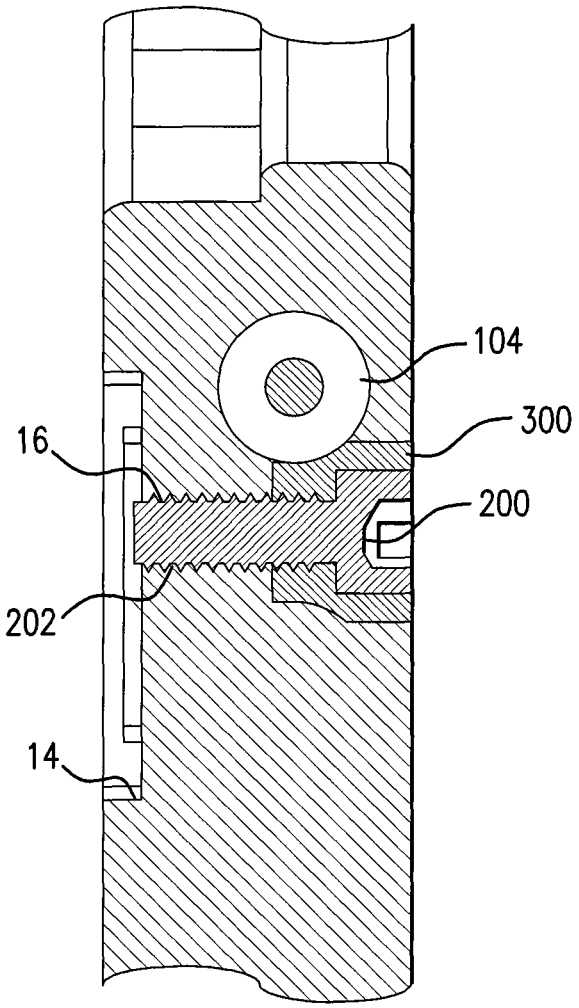
FIG. 3 is a cross sectional view of the archery bow shown in FIG. 2.

FIG. 1 to FIG. 3 depict a cable guard 100 and an archery bow 10 according to one embodiment. The archery bow 10 has a handle portion 12 and a riser 14. The riser 14 having a first bore 18 extending into and terminating within the riser 14. In one embodiment, the internal surface of the first bore is smooth (e.g. not threaded). A second bore 20 extends generally orthogonally to, and intersects the first bore 18. In one embodiment, the second bore 20 bisects the first bore 18. The second bore 20 terminates within the riser 14.

A cable guard 100 having a protruding end 102 and an insertion end 104. The insertion end 104 is inserted into the first bore 18. The cable guard 100 is used to ensure that an arrow has adequate clearance from the archery bow's cables when fired.

The riser 14 further contains a second bore 20 that terminates within the riser 14. The second bore 20 has a threaded portion 16 within the riser 14. The threaded portion 16 being a monolithic part of the riser 14 itself, eliminating the need for additional nuts or other device.

To secure the cable guard 100 to the riser 14, a screw 200 having male threads 202 and a retention device 300 may be used. The screw 200 is inserted into the second bore 20 and the male threads 202 mate with the threaded portion 16. Upon tightening of the screw 200 the retention device 300 contacts the outer diameter of the cable guard 100. The friction between the outer diameter of the insertion end 104 and the retention device 300 secures the cable guard 100 to the riser 14. It is understood that while the axis of the second bore 20 is shown being 90 degrees away from the axis of the first bore 18 that the bore may enter at an angle. In one embodiment the axis of the second bore is between 30 and 90 degrees from the axis of the first bore. In another embodiment, the axis of the second bore is between 45 and 90 degrees from the axis of the first bore. In yet another embodiment, the axis of the second bore is between 60 and 90 degrees from the axis of the first bore. In one embodiment, the first bore 18 and the second bore 20 are offset from one another such that each respective axis does not intersect, although the first bore 18 and the second bore 20 still intersect.

The retention device 300 may be any suitable material, including but not limited to, metals, alloys, plastics, ceramics and the like. In one embodiment the retention device is a monolithic portion of the screw 200. In another embodiment, the retention device is a distinct part that attaches to the screw 200 to form a two-piece structure. In one embodiment, the retention device 300 is a collar that circumscribes the screw 200. In the exemplary embodiment of FIG. 3, the retention device 300 contacts only the outer surface of the insertion end 104.

In one embodiment, the insertion end 104 further contains a notched groove around the perimeter of the cable guard (not shown). Once inserted, the retention device 300 engages the notched groove to secure the cable guard 100. The notched groove provides additional retention of the cable guard to the riser.

While the embodiment described above refers to cable guards, it is understood that similar attachment mechanisms can be used to attach a string stop to the riser without detracting from the invention.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A bow comprising:

a riser having:

a first bore facing a front of the riser;

a second bore facing a side of the riser, the second bore intersecting the first bore, wherein the second bore has threads;

an elongated cable guard having a protruding end and an insertion end, the insertion end being inserted within the first bore;

a screw, disposed within the second bore and mated with the threads, the screw comprising a retention device that engages the insertion end of the elongated cable guard, thereby retaining the insertion end within the first bore; and wherein the insertion end comprises a notch and the retention device engages the insertion end at the notch.

2. The bow as recited in claim 1, wherein the retention device is monolithic with respect to the screw.

3. The bow as recited in claim 1, wherein the retention device comprises a collar that circumscribes the screw.

4. The bow as recited in claim 1, wherein the retention device engages the insertion end only at the insertion end's outer surface.

5. The bow as recited in claim 1, wherein the first bore has a first axis and the second bore has a second axis, the first axis and second axis being offset from one another such that the first axis and second axis do not intersect.

6. The bow as recited in claim 1, wherein the first bore has a smooth internal surface.

7. The bow as recited in claim 1, wherein the first bore terminates within the riser.

8. A bow comprising:

a riser having:

a first bore facing a front of the riser;

a second bore facing a side of the riser, the second bore intersecting the first bore, wherein the second bore has threads;

an elongated cable guard having a protruding end and an insertion end, the insertion end being inserted within the first bore;

a screw, disposed within the second bore and mated with the threads, the screw comprising a retention device that engages the insertion end of the elongated cable guard, thereby retaining the insertion end within the first bore; and wherein the threads are formed by a surface of the riser.

9. The bow as recited in claim 8, wherein the retention device is monolithic with respect to the screw.

10. The bow as recited in claim 8, wherein the retention device comprises a collar that circumscribes the screw.

11. The bow as recited in claim 8, wherein the retention device engages the insertion end only at the insertion end's outer surface.

12. The bow as recited in claim 8, wherein the first bore has a first axis and the second bore has a second axis, the first axis and second axis being offset from one another such that the first axis and second axis do not intersect.

13. The bow as recited in claim 8, wherein the first bore has a smooth internal surface.

14. The bow as recited in claim 8, wherein the first bore terminates within the riser.

15. A bow comprising:

a riser having:

a first bore facing a front of the riser;

a second bore facing a side of the riser, the second bore intersecting the first bore, wherein the second bore has threads;

an elongated cable guard having a protruding end and an insertion end, the insertion end being inserted within the first bore;

a screw, disposed within the second bore and mated with the threads, the screw comprising a retention device that engages the insertion end of the elongated cable guard, thereby retaining the insertion end within the first bore; and wherein the second bore terminates within the riser.

16. The bow as recited in claim 15, wherein the retention device is monolithic with respect to the screw.

17. The bow as recited in claim 15, wherein the retention device comprises a collar that circumscribes the screw.

18. The bow as recited in claim 15, wherein the retention device engages the insertion end only at the insertion end's outer surface.

19. The bow as recited in claim 15, wherein the first bore has a first axis and the second bore has a second axis, the first axis and second axis being offset from one another such that the first axis and second axis do not intersect.

20. The bow as recited in claim 15, wherein the first bore has a smooth internal surface.

21. The bow as recited in claim 15, wherein the first bore terminates within the riser.

22. A bow comprising:

a riser having:

a first bore facing a front of the riser;

a second bore facing a side of the riser, the second bore intersecting the first bore, wherein the second bore has threads;

an elongated cable guard having a protruding end and an insertion end, the insertion end being inserted within the first bore;

a screw, disposed within the second bore and mated with the threads, the screw comprising a retention device that engages the insertion end of the elongated cable guard, thereby retaining the insertion end within the first bore;

wherein the first and second bores both terminate with the riser, the first bore having a first axis and the second bore has a second axis, the first axis and second axis being offset from one another such that the first axis and second axis do not intersect.

23. The bow as recited in claim 22, wherein the first bore has a smooth internal surface.

24. The bow as recited in claim 22, wherein the threads are formed by a surface of the riser.

25. The bow as recited in claim 22, wherein the insertion end comprises a notch and the retention device engages the insertion end at the notch.

26. The bow as recited in claim 22, wherein the retention device engages the insertion end only at the insertion end's outer surface.

* * * * *